US005722573A

United States Patent [19]

Carnel

[11] Patent Number: 5,722,573

[45] Date of Patent: Mar. 3, 1998

[54] PORTABLE SYSTEM FOR DELIVERING A DRINKING BEVERAGE

[76] Inventor: Christopher Paul Carnel, 5073 San Feliciano Dr., Woodland Hills, Calif. 91364

[21] Appl. No.: 692,769

[22] Filed: Aug. 6, 1996

[51] Int. Cl.[6] ..... A45F 5/00

[52] U.S. Cl. ..... 224/148.2; 224/148.4; 227/175

[58] Field of Search ..... 224/148.2–148.7; 222/175; 2/105, 106, 114, 115, 247; 128/202.15

[56] References Cited

U.S. PATENT DOCUMENTS

| | | | |
|---|---|---|---|
| 3,242,951 | 3/1966 | Curie et al. | 141/21 |
| 4,544,087 | 10/1985 | Modig | 224/148.2 |
| 4,948,023 | 8/1990 | Tripp | 224/148.2 |
| 5,060,833 | 10/1991 | Edison et al. | 222/175 |

*Primary Examiner*—Henry J. Recla
*Assistant Examiner*—Timothy L. Maust
*Attorney, Agent, or Firm*—Frederick Gotha

[57] ABSTRACT

A portable system for delivering a drinking beverage to a user is presented which has a carrier fabric made at least in part of a flexible material that has a pocket and a conduit sheath where the conduit sheath communicates with the pocket. A flexible beverage reservoir which has a sealed chamber therein is removably mounted to the carrier fabric and captively held in the pocket. Disposed in the beverage reservoir is a connector which has an intake port and exhaust port where the ports are located externally of the sealed chamber and in communication with the sealed chamber. The connector contains a two-way valve for admitting of beverage through the intake port into the sealed chamber and for removing beverage from the sealed chamber through the exhaust port. A beverage delivery lumen has a first end and a second end where the first end is connected to the exhaust port and the second end has an opening with a one-way valve for the sucking of beverage through the lumen into the mouth of a user.

13 Claims, 3 Drawing Sheets

PORTABLE SYSTEM FOR DELIVERING A DRINKING BEVERAGE

FIELD OF THE INVENTION

This invention relates to a portable beverage delivery system for delivering a drinking beverage to a user.

BACKGROUND OF THE INVENTION

In many athletic activities, particularly those types of activities where the athlete does not have ready access to a drinking beverage, it is desirable that a portable system be provided which permits the athlete to continue in the activity without interruption. For example, in surfing type activities, to obtain a drinking beverage would require the surfer to discontinue the activity and return to shore in order to quench his thirst. Where light weight is required, in activities such as cycling and surfing, the reservoir for the beverage should be made of a flexible material and capable of being removably carried by a garment worn by the user. It is also desirable for the comfort of the cyclist or surfer when wearing an upper torso garment containing the beverage reservoir that the bulkiness of the reservoir after being filled with a beverage be minimized.

In the prior art a portable beverage delivery system utilizing a tube for conducting the beverage from the reservoir to the user has been incorporated into backpacks for hiking. Such a device, however, would be impractical and unmanageable for sports such as surfing, windsurfing, jogging, or competitive cycling. Thus, it is desirable to continue participation in a sport without the necessity of interrupting that activity when the participant becomes thirsty.

SUMMARY OF THE INVENTION

The present invention is directed to a portable system for delivering a drinking beverage to a user where a flexible beverage reservoir which has a fluid sealed chamber within it, is removably insertable into a carrier garment made of fabric.

The portable system for delivering a drinking beverage to a user of this invention has a carrier fabric made at least in part of a flexible material where the carrier fabric contains a pocket and a conduit sheath which communicates with the pocket. A flexible beverage reservoir is removably insertable in the pocket and contains a fluid sealed chamber within it. The fluid sealed chamber has opposing internal flexible walls which define the boundary of the fluid sealed chamber and the walls are integrally pinched at approximately the center of the chamber to prevent the reservoir from becoming bulky after being filled with a beverage. A connector having a fluid intake exhaust port communicates with the sealed chamber and contains a two-way valve to permit fluid to flow into and out of the chamber. A beverage delivery lumen communicates with the two-way valve at one end and is open at the other; at the open end a one-way valve is contained within the lumen to permit beverage flow from the flexible beverage reservoir to the user's mouth.

BRIEF DESCRIPTION OF THE DRAWINGS

These and other features and advantages will become appreciated as the same become better understood with reference to the following specification, claims and drawings wherein:

DETAILED DESCRIPTION

Figure 1:
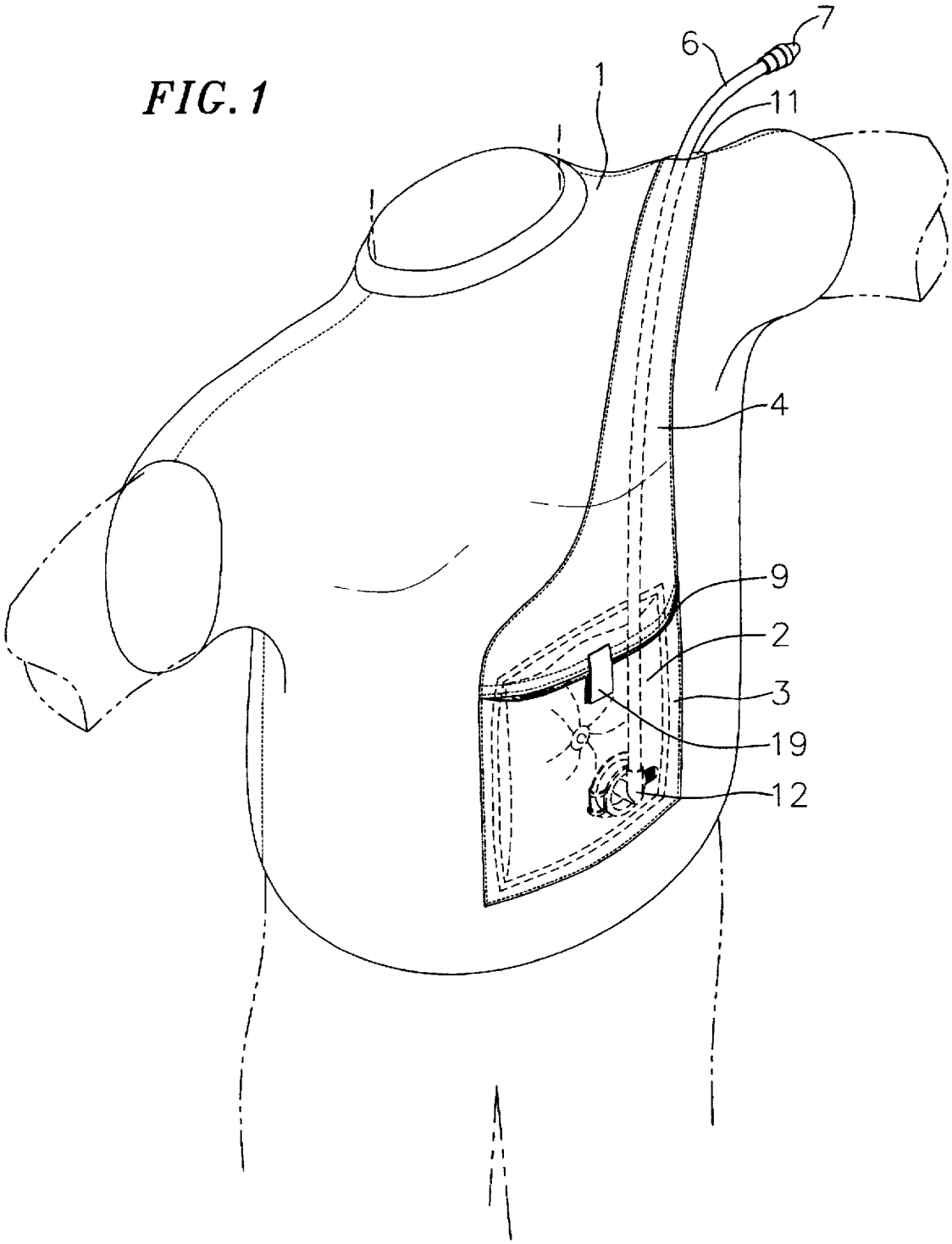
FIG. 1 is a perspective view of the portable system for delivering a drinking beverage illustrating a flexible garment material holding the flexible reservoir and containing a sheath for the delivery lumen of this invention.

The portable system for delivering a drinking beverage to a user of this invention is shown in perspective in FIG. 1. A flexible garment 1 is illustrated in FIG. 1. As a general representation of a carrier for a flexible beverage reservoir 2. In surfing for instance, flexible garment 1 may represent a Lycra rash guard worn by a surfer under a wet suit. In the illustrated embodiment, flexible garment 1 has a pocket 3 for receiving the flexible beverage reservoir 2. As can be seen in FIG. 1, the pocket 3 is sewn into flexible garment 1 and communicates with a conduit sheath 4 which is also sewn into flexible garment 1 to provide a conduit for captively holding tubular member 6; the distal end of tubular member 6 contains a mouthpiece 7 which communicates with the lumen 8 and has a one-way valve (not shown) to permit the user to suck beverage from the flexible beverage reservoir 2 through tubular member 6.

To insert the flexible beverage reservoir 2 into pocket 3, a slit 9 is utilized which permits the flexible beverage reservoir 2 to be readily insertable into pocket 3 while the tubular member 6 can be extended through a conduit sheath 4 and emerge through opening 11 proximately at shoulder level of the user.

Figure 2:
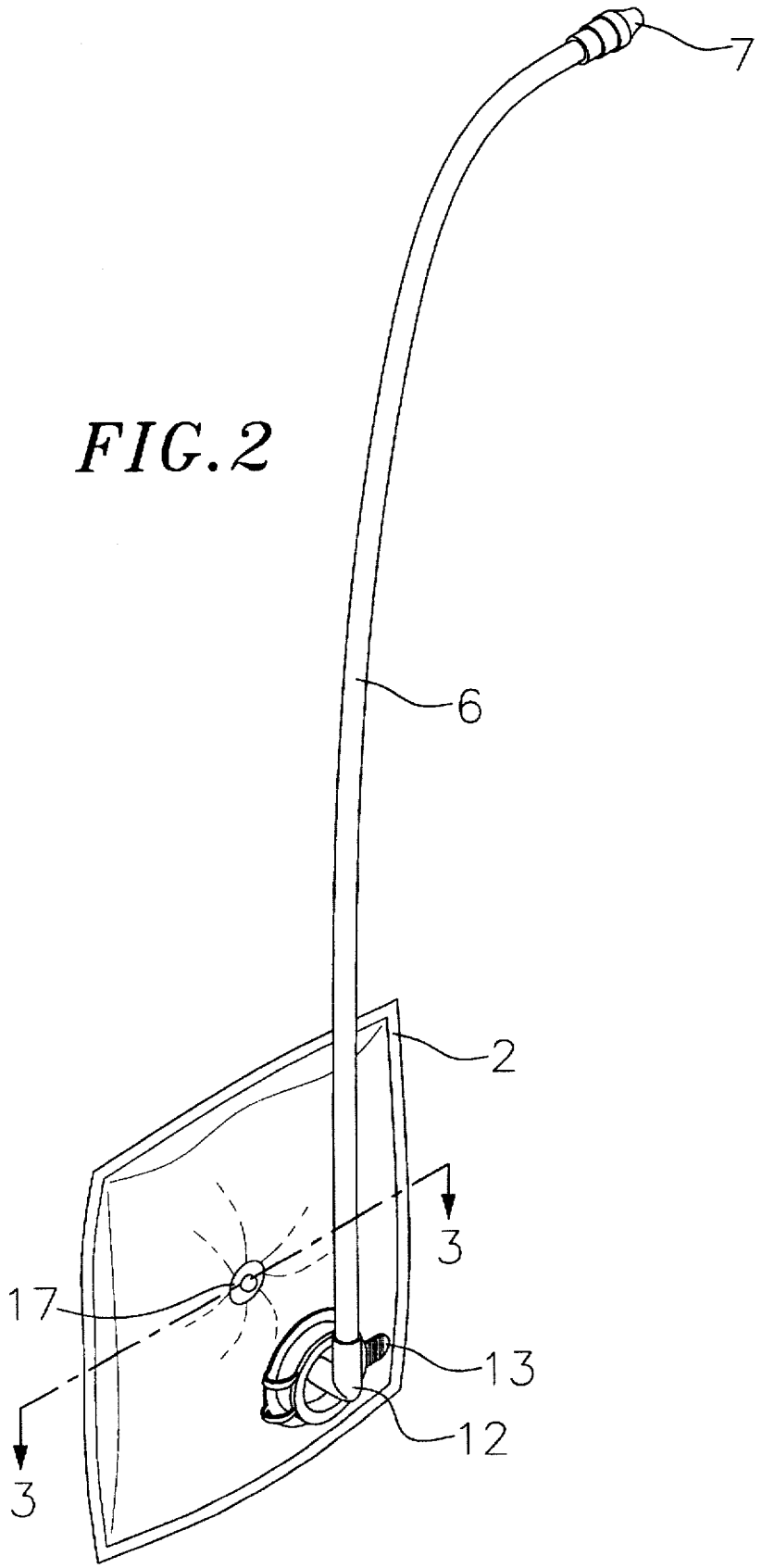
FIG. 2 illustrates the flexible fluid reservoir and the delivery lumen of this invention.
Figure 3:
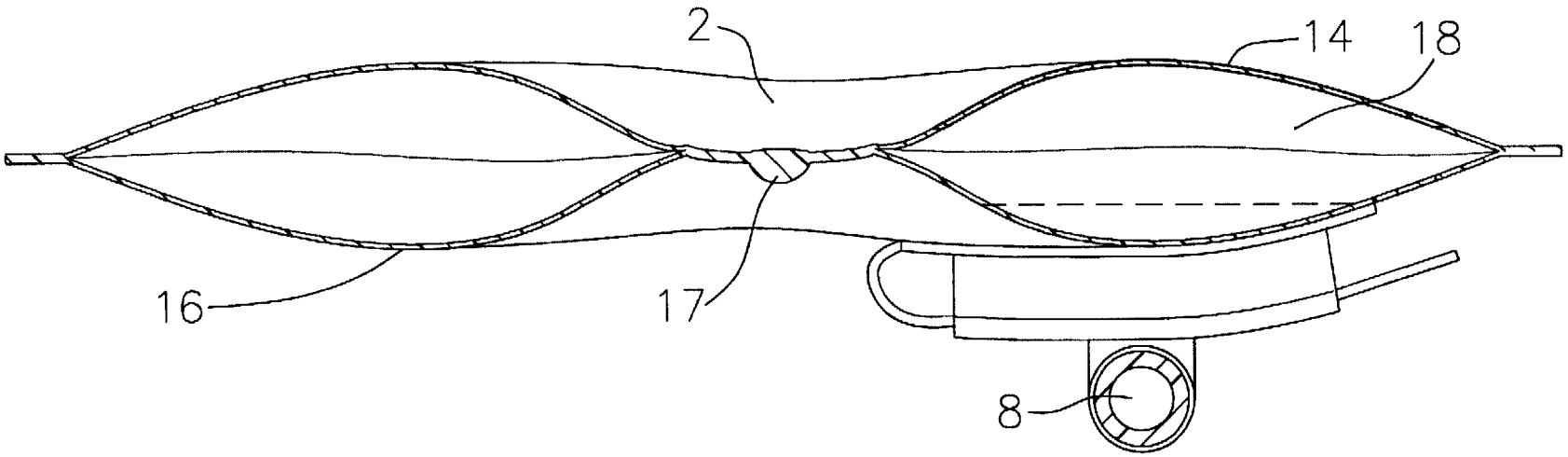
FIG. 3 is a cross-sectional view taken along the line 3—3 of FIG. 2.

By referring to FIG. 2, the flexible beverage reservoir 2 and tubular member 6 are illustrated in a removed configuration from pocket 3. As can be seen in FIG. 2, the tubular member 6 at its proximate end has a connector 12 containing a two-way valve (not shown) through which beverage may be admitted into flexible beverage reservoir 2 through the intake port 13 and sucked into the lumen 8 of tubular member 6. By the user sucking on the mouthpiece 7, the one-way valve in the mouthpiece 7 communicating with lumen 8 is opened thereby permitting beverage to flow through the lumen 8 of tubular member 6. As can further be seen in FIG. 3, the flexible beverage reservoir 2 has flexible internal walls 14 and 16 which are integrally pinched by heat seal forming a central integral connection 17 between flexible internal walls 14 and 16. Although the central heat sealed pinch is shown in FIG. 3, is the preferred construction of the portable system for delivering a drinking beverage of this invention, the integral connection may also be achieved by a fastener to clamp the central region of the flexible internal walls together which prevents the flexible beverage reservoir of becoming bulky and promotes a more uniform distribution of the beverage within the fluid sealed chamber 18. Thus, for use in athletic endeavors where a sustained activity is required, a portable system for delivering a drinking beverage to a user has been described and allows the user to quench his thirst by merely sucking through mouthpiece 7 to obtain delivery of a beverage. As above mentioned, the torso garment shown in FIG. 1 may be a rash guard used for surfing where the rash guard is made of a flexible Lycra material. As can be seen by reference to FIG. 1, the preferred location of the pocket 3 and conduit sheath 4 would be on the back or posterior side of the garment thus making it more comfortable for the surfer when the anterior portion of his body is pressed against the surfboard.

Although the pocket 2 and conduit sheath are shown in FIG. 1 as being sewn to the flexible garment 1, there are many other ways in the prior art in which the pocket and sheath may be attached to the garment. For instance, a Velcro material could be utilized to affix the sheath and pocket to the anterior or posterior of the torso garment 1. As shown in the pocket illustration of FIG. 1, a tab 19 may be used to keep slit 9 from opening after the flexible beverage reservoir 2 is inserted into the pocket 3. Additionally, the connector 12 is well known in the prior art and is so designed and constructed to permit the flexible beverage reservoir to be filled with beverage through the inlet port 13.

In other embodiments of this invention, the portable system for delivering a drinking beverage may be carried by a golf bag to permit the golfer to have a ready supply of beverage available at any time while he is playing the game. Other uses of the system for delivering a drinking beverage to a user would include a cyclist, a windsurfer, a hiker and any other type of activity where prolonged participation would be required without interruption for replenishing body fluids.

While I have shown and described a portable system for delivering a drinking beverage to a user, it is to be understood that the invention is subject to many modifications without departing from the scope and spirit of the claims as recited herein. This invention is not to be limited by the embodiment shown in the drawing and described in the description which is given by way of example and not of limitation.

What is claimed is:

1. A portable system for delivering a drinking beverage to a user, comprising:

(a) a carrier fabric made at least in part of a flexible material having a pocket;

(b) a flexible beverage reservoir having a sealed chamber therein removably mounted to said carrier fabric and captively held in said pocket;

(c) a connector disposed in said beverage reservoir having an intake port and exhaust port located externally of said sealed chamber and in communication therewith;

(d) a beverage delivery lumen having a first end and a second end where said first end is connected to said exhaust port and said second end has an opening, and where said beverage delivery lumen is so adapted that said beverage may be sucked into said lumen by a user;

(e) valve means associated with said connector for admitting said beverage through said intake port into said sealed chamber and removing said beverage through said exhaust port.

2. The portable system for delivering a drinking beverage recited in claim 1 where said sealed chamber comprises opposing internal flexible walls defining the boundary of said sealed chamber and fastening means for integrally fastening said opposing internal flexible walls at a preselected location within said sealed chamber.

3. The portable system for delivering a drinking beverage recited in claim 1 further comprising one-way valve means carried by said beverage delivery lumen adjacent said second end and communicating with said opening where said one-way valve means is normally closed and responsive to suction applied by said user to open said one-way valve means thereby permitting said beverage to flow into the mouth of said user.

4. The portable system for delivering a drinking beverage recited in claim 3 where said one-way valve means comprises a one-way valve.

5. The portable system for delivering a drinking beverage recited in claim 1 where said carrier fabric is a shirt worn on the upper torso of said user.

6. The portable system for delivering a drinking beverage recited in claim 5 where said shirt is a surfer's rash guard and said flexible material is a Lycra material.

7. The portable system for delivering a drinking beverage recited in claim 1 where said carrier fabric is a life vest.

8. A portable system for delivering a drinking beverage to a user, comprising:

(a) a carrier fabric made at least in part of a flexible material having a pocket and a conduit sheath where said conduit sheath communicates with said pocket;

(b) a flexible beverage reservoir having a sealed chamber therein removably mounted to said carrier fabric and captively held in said pocket;

(c) valve means carried by said flexible beverage reservoir for admitting said beverage into said sealed chamber and for removing said beverage;

(d) a beverage delivery lumen carried at least in part by said conduit sheath having a first end and a second end where said first end communicates with said sealed chamber and said second end has an opening, said beverage delivery lumen is so adapted that said beverage may be sucked into said lumen by a user and where said carrier fabric is a shirt worn on the upper torso of said user.

9. The portable system for delivering a drinking beverage recited in claim 8 where said shirt is a surfer's rash guard and said flexible material is a Lycra material.

10. A portable system for delivering a drinking beverage to a user, comprising:

(a) a carrier fabric made at least in part of a flexible material having a pocket;

(b) a flexible beverage reservoir having a sealed chamber therein removably mounted to said carrier fabric and captively held in said pocket;

(c) valve means carried by said flexible beverage reservoir communicating with said sealed chamber for admitting said beverage into said sealed chamber and for permitting the siphoning of said beverage from said sealed chamber;

(d) a beverage delivery lumen having a first end and a second end where said first end communicates with said valve means and said second end has an opening, and where said beverage delivery lumen is so adapted that said beverage may be siphoned from said sealed chamber by suction of said delivery lumen by a user.

11. The portable system for delivering a drinking beverage recited in claim 10 further comprising one-way valve means carried by said beverage delivery lumen adjacent said second end for sucking said beverage through said beverage delivery lumen where said one-way valve means is normally closed and responsive to suction by said user such that upon suction by said user said one-way valve is opened thereby permitting said beverage to flow into the mouth of said user.

12. The portable system for delivering a drinking beverage recited in claim 11 where said carrier fabric is a shirt worn on the upper torso of said user.

13. The portable system for delivering a drinking beverage recited in claim 12 where said shirt is a surfer's rash guard and said flexible material is a Lycra material.

* * * * *